US008976973B2

(12) United States Patent
Hakoda

(10) Patent No.: US 8,976,973 B2
(45) Date of Patent: Mar. 10, 2015

(54) SOUND CONTROL DEVICE, COMPUTER-READABLE RECORDING MEDIUM, AND SOUND CONTROL METHOD

(75) Inventor: Kotaro Hakoda, Osaka (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 690 days.

(21) Appl. No.: 13/384,904

(22) PCT Filed: May 19, 2011

(86) PCT No.: PCT/JP2011/002801
§ 371 (c)(1),
(2), (4) Date: Jan. 19, 2012

(87) PCT Pub. No.: WO2011/158435
PCT Pub. Date: Dec. 22, 2011

(65) Prior Publication Data

US 2012/0114144 A1 May 10, 2012

(30) Foreign Application Priority Data

Jun. 18, 2010 (JP) ..... 2010-139357

(51) Int. Cl.
*H04R 29/00* (2006.01)
*G10L 21/06* (2013.01)
*G10L 13/033* (2013.01)

(52) U.S. Cl.
CPC ..... *G10L 21/06* (2013.01); *G10L 13/033* (2013.01)
USPC ..... 381/56; 381/104; 381/107; 700/94

(58) Field of Classification Search
USPC ..... 381/2, 56, 61, 98, 101, 102, 103, 104, 381/107, 119; 700/94; 386/46, 53, 54, 230; 360/13
See application file for complete search history.

(56) References Cited

U.S. PATENT DOCUMENTS 5,974,219 A 10/1999 Fujita et al.
7,233,948 B1 * 6/2007 Shamoon et al. ..... 1/1
(Continued)

FOREIGN PATENT DOCUMENTS

CN 101361124 2/2009
JP 5-232601 9/1993
(Continued)

OTHER PUBLICATIONS

International Search Report issued Jun. 14, 2011 in International (PCT) Application No. PCT/JP2011/002801.

*Primary Examiner* — Vivian Chin
*Assistant Examiner* — Friedrich W Fahnert
(74) *Attorney, Agent, or Firm* — Wenderoth, Lind & Ponack, L.L.P.

(57) ABSTRACT

Sound is outputted, without giving the sense of incongruity to the user, even if reproduction of animation is stopped by the user. An animation acquiring section 11 acquires animation data D1 representing an animation generated in advance based on a setting operation by the user, and sound data D2 representing a sound to be reproduced in association with the animation. A sound output control section 12 calculates stop time sound information representing a feature of the sound at a point of time at which reproduction of the animation is stopped, using sound attribute information D4, in response to input of a stop command by the user, and determines a predetermined output method of the sound that matches the animation, based on the calculated stop time sound information, to reproduce the sound by the determined output method.

11 Claims, 10 Drawing Sheets

(56) References Cited

U.S. PATENT DOCUMENTS

| | | | | |
|---|---|---|---|---|
| 8,046,094 | B2 | 10/2011 | Wada | |
| 2003/0231871 | A1* | 12/2003 | Ushimaru | 386/96 |
| 2006/0122842 | A1* | 6/2006 | Herberger et al. | 704/278 |
| 2007/0071413 | A1* | 3/2007 | Takahashi et al. | 386/96 |
| 2008/0025529 | A1* | 1/2008 | Keohane et al. | 381/104 |
| 2008/0269930 | A1 | 10/2008 | Yamashita et al. | |
| 2010/0168883 | A1 | 7/2010 | Wada | |
| 2010/0208918 | A1* | 8/2010 | Noguchi | 381/107 |
| 2013/0159852 | A1* | 6/2013 | Classen et al. | 715/716 |

FOREIGN PATENT DOCUMENTS

| | | |
|---|---|---|
| JP | 9-107517 | 4/1997 |
| JP | 2000-339485 | 12/2000 |
| JP | 2006-155299 | 6/2006 |
| JP | 2009-117927 | 5/2009 |
| JP | 2009-226061 | 10/2009 |
| JP | 2009-289385 | 12/2009 |
| JP | 2010-128137 | 6/2010 |
| JP | 2010-152281 | 7/2010 |

* cited by examiner 1
11
ANIMATION ACQUIRING SECTION
13
ANIMATION DISPLAY CONTROL SECTION
14
DISPLAY SECTION
12
SOUND OUTPUT CONTROL SECTION
15
SOUND OUTPUT SECTION
16
SOUND ANALYZING SECTION
17
CONTROL INFORMATION STORAGE
18
SOUND ATTRIBUTE INFORMATION STORAGE
19
OPERATION SECTION
OPERATION BY USER
D1,D3
D2,D3,D5
D2
D4
D4

FIG.4

TB1

| | RELATIVE VOLUME (F1) | SOUND CONTROL INFORMATION (F2) |
|---|---|---|
| R1 | LARGE VOLUMES (NOT LESS THAN 60% OF MAXIMUM VOLUME) | FADE OUT AT REDUCTION RATE :(−1/2)*(VOLUME AT STOP TIME/ELAPSED TIME) |
| R2 | MEDIUM VOLUMES (NOT LESS THAN 40% BUT LESS THAN 60% OF MAXIMUM VOLUME) | FADE OUT AT REDUCTION RATE :(−1)*(VOLUME AT STOP TIME/ELAPSED TIME) |
| R3 | SMALL VOLUMES (LESS THAN 40% OF MAXIMUM VOLUME) | FADE OUT AT REDUCTION RATE :(−2)*(VOLUME AT STOP TIME/ELAPSED TIME) |

TB2

| FILE NAME (F3) | MAXIMUM VOLUME (F4) |
|---|---|
| myMusic.wav | 50 |

FIG.10

TB11

| FREQUENCY (F11) | | SOUND CONTROL INFORMATION (F12) | |
|---|---|---|---|
| NON-AUDIBLE FREQUENCY RANGE (~20Hz) | | MUTE | R11 |
| AUDIBLE FREQUENCY RANGE | 20Hz~500Hz | FADE OUT AT REDUCTION RATE :(−2)*(VOLUME AT STOP TIME/ELAPSED TIME) | R12 |
| | 500Hz~1500Hz | FADE OUT AT REDUCTION RATE :(−1)*(VOLUME AT STOP TIME/ELAPSED TIME) | R13 |
| | 1500Hz~2500Hz | FADE OUT AT REDUCTION RATE :(−1/2)*(VOLUME AT STOP TIME/ELAPSED TIME) | R14 |
| | 2500Hz~ | FADE OUT AT REDUCTION RATE: (−1)*(VOLUME AT STOP TIME/ELAPSED TIME) | R15 |

SOUND CONTROL DEVICE, COMPUTER-READABLE RECORDING MEDIUM, AND SOUND CONTROL METHOD

TECHNICAL FIELD

The present invention relates to a technology of controlling the sound of animation.

BACKGROUND ART

In recent years, there have been spread portable phones and digital home electrical appliances loaded with a high-performance memory or CPU. Further, as the broadband Internet service has been spread, various tools are available, with which the user can easily create applications for implementing various animations, or animations themselves.

In the animations created with use of such tools, it is necessary to secure the integrity between the movement of animation and the sound of animation.

As a conventional technology relating to the above needs, there has been known an animation generation device disclosed in e.g. patent literature 1. FIG. 11 is a block diagram showing the animation generation device disclosed in patent literature 1.

The animation generation device shown in FIG. 11 is provided with a user setting section 300, an object attribute acquiring section 304, a sound processing section 305, an animation generating section 101, and a display section 102. The user setting section 300 includes an object setter 301, an animation setter 302, and a sound file setter 303, with which the user performs a setting operation for an animation effect.

The object setter 301 generates object data representing an object to be animated and displayed in response to a setting operation by the user. The animation setter 302 generates animation effect information representing an animation effect in response to a setting operation by the user. The sound file setter 303 generates sound data of animation in response to a setting operation by the user.

The object attribute acquiring section 304 acquires object attribute information representing an attribute (such as the shape, the color, the size, and the position) of an object to which an animation effect is applied.

The sound processing section 305 includes an edition lookup table 306, a waveform edition device 307, and a processing controller 308, with which a sound file is processed and edited, based on animation effect information and object attribute information.

The edition lookup table 306 stores therein a correlation between object attribute information and parameters for waveform edition, and a correlation between animation effect information and parameters for waveform edition. In this example, as a correlation between object attribute information and parameters for waveform edition, for instance, there is used a correlation that a sound which gives greater impact is correlated to an object which gives visually strong impression.

As a correlation between animation effect information and parameters for waveform edition, for instance, there is used a correlation that a waveform edition parameter indicating "an object is gradually enlarged and displayed" is correlated to an animation effect "zoom-in".

The processing controller 308 specifies a waveform edition parameter corresponding to animation effect information from the edition lookup table 306, and controls the waveform edition device 307 to execute a waveform edition processing using the specified waveform edition parameter.

The waveform edition device 307 performs a waveform edition processing using a waveform edition parameter specified by the processing controller 308.

The animation generating section 101 generates an animation of an object to be animated, utilizing sound data which has been processed and edited by the processing controller 308. The display section 102 outputs the animation and the sound generated by the animation generating section 101.

As described above, in the animation generation device disclosed in patent literature 1, the length and the volume of sound are adjusted in such a manner as to match the feature of an object to be animated and displayed, such as the color, the size, and the shape, which have been set in advance by the user. Thus, the integrity between the movement and the sound of animation is secured.

In recent years, animation is actively used at e.g. a user interface of a digital home electrical appliance. Reproduction of animation may be stopped at the user interface in response to a user's operation or command.

In the animation generation device disclosed in patent literature 1, however, there is no disclosure about as to how the sound is treated, in the case where reproduction of animation is stopped during a reproducing operation. In the above animation generation device, even if the sound is edited in such a manner that the sound matches the movement of animation before reproduction of the animation is started, in the case where reproduction of the animation is suspended in response to a user's operation or command, the sound is continued to be played, which may make it difficult or impossible to secure the integrity between the movement and the sound of animation. As a result, the animation may give the sense of incongruity to the user.

As described above, in the case where an animation generated by the device disclosed in patent literature 1 is simply applied to a user interface of e.g. a digital home electrical appliance, if reproduction of the animation is stopped at an unintended timing by the user, the sound may continue to be played, and the user may feel the sense of incongruity.

CITATION LIST

Patent Literature

JP 2000-339485A

SUMMARY OF INVENTION

An object of the invention is to provide a technology that enables to output sounds without giving the sense of incongruity to the user, even if reproduction of animation is suspended by the user.

A sound control device according to an aspect of the invention includes an animation acquiring section which acquires animation data representing an animation produced in advance based on a setting operation by a user, and sound data representing a sound to be reproduced in association with the animation data; a sound analyzing section which analyzes a feature of the sound data from start to finish to generate a sound attribute information; an animation display control section which reproduces the animation based on the animation data, and stops the reproduction of the animation when a stop command for stopping animation reproduction is inputted; and a sound output control section which reproduces the sound based on the sound data. In this arrangement, the sound output control section calculates, when the stop command is inputted, a stop time sound information representing a feature of sound at a point of time at which the reproduction of the animation is stopped using the sound attribute information, and determines, based on the calculated stop time sound information, a predetermined output method for the sound that matches the animation whose reproduction is stopped, and allows the reproduction of the sound by the determined output method.

A computer-readable recording medium which stores a sound control program according to another aspect of the invention causes a computer to function as: an animation acquiring section which acquires animation data representing an animation produced in advance based on a setting operation by a user, and sound data representing a sound to be reproduced in association with the animation; a sound analyzing section which analyzes a feature of the sound data from start to finish to generate a sound attribute information; an animation display control section which reproduces the animation based on the animation data, and stops the reproduction of the animation when a stop command for stopping animation reproduction is inputted; and a sound output control section which reproduces the sound based on the sound data. In this arrangement, the sound output control section calculates, when the stop command is inputted, a stop time sound information representing a sound feature at a point of time at which the reproduction of the animation is stopped using the sound attribute information, and determines, based on the calculated stop time sound information, a predetermined output method for the sound that matches the animation whose reproduction is stopped and allows the reproduction of the sound by the determined output method.

A sound control method according to yet another aspect of the invention includes an animation acquiring step of acquiring, by a computer, animation data representing an animation produced in advance based on a setting operation by a user, and sound data representing a sound to be reproduced in association with the animation data; a sound analyzing step of analyzing, by the computer, a feature of the sound data from start to finish to generate a sound attribute information; an animation display control step of reproducing, by the computer, the animation based on the animation data, and stopping the reproduction of the animation when a stop command for stopping animation reproduction is inputted; and a sound output control step of reproducing, by the computer, the sound based on the sound data. In this arrangement, in the sound output control step, when the stop command is inputted, a stop time sound information representing a sound feature at a point of time at which the reproduction of the animation is stopped is calculated using the sound attribute information, and a predetermined output method for the sound that matches the animation whose reproduction is stopped is determined based on the calculated stop time sound information, the reproduction of the sound by the determined output method is allowed.

BRIEF DESCRIPTION OF DRAWINGS

FIG. 4 is a diagram showing an example of a data structure of a sound control information table stored in a control information storage.

FIG. 10 is a diagram showing an example of a data structure of a sound control information table in a second embodiment of the invention.

DESCRIPTION OF EMBODIMENTS

First Embodiment

Figure 1:
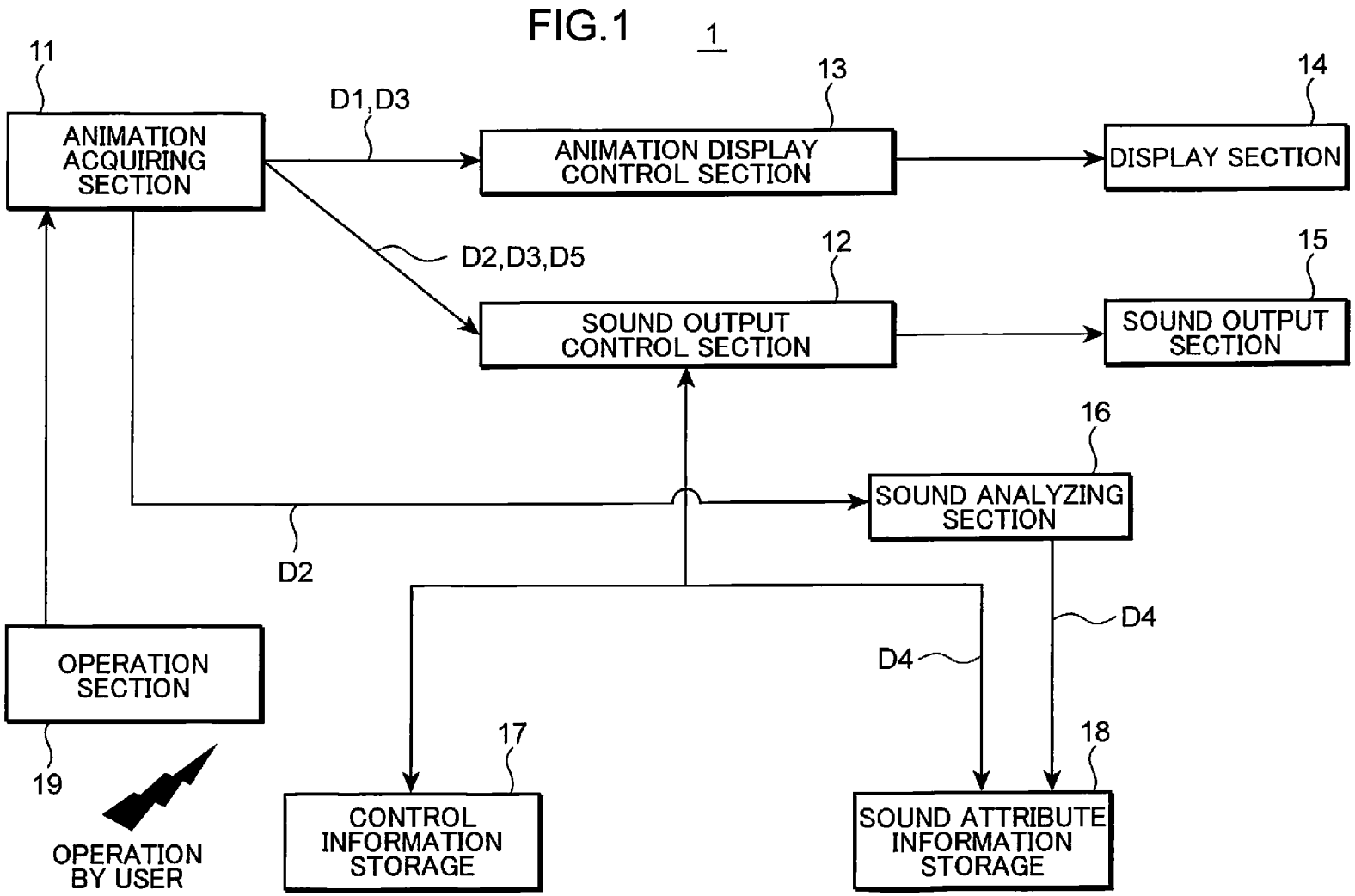
FIG. 1 is a block diagram showing an arrangement of a sound control device according to an embodiment of the invention.

In the following, a sound control device according to an embodiment of the invention is described referring to the drawings. FIG. 1 is a block diagram showing an arrangement of a sound control device 1 in the embodiment of the invention. The sound control device 1 is provided with an animation acquiring section 11, a sound output control section 12, an animation display control section 13, a display section 14, a sound output section 15, a sound analyzing section 16, a control information storage 17, a sound attribute information storage 18, and an operation section 19.

The animation acquiring section 11, the sound output control section 12, the animation display control section 13, the sound analyzing section 16, the control information storage 17, and the sound attribute information storage 18 are implemented by causing a computer to execute a sound control program for functioning the computer as a sound control device. The sound control program may be provided to the user by storing the program in a computer-readable recording medium, or may be provided to the user by letting the user download the program via the network. Further alternatively, the sound control device 1 may be applied to an animation generation device for use in generating animation by the user, or may be applied to a user interface of a digital home electrical appliance.

The animation acquiring section 11 acquires animation data D1 representing an animation generated in advance based on a user's setting operation, and sound data D2 representing a sound to be reproduced in association with the animation.

In this example, the animation data D1 includes the object data, the animation effect information, and the object attribute information described in patent literature 1. These data is generated in advance in response to a user's setting operation using e.g. the operation section 19.

The object data is data for defining an object to be animated and displayed. For instance, in the case where three objects are animated and displayed, data indicating the object name of each of the objects A, B, C is used.

The animation effect information is data for defining e.g. a movement of each object defined by the object data, and includes e.g. a moving time of an object and a moving pattern of an object. Examples of the moving pattern are zoom-in, with which an object is gradually enlarged and displayed, zoom-out, with which an object is gradually reduced and displayed, and sliding, with which an object is slidingly moved from a certain position to another position on a screen at a predetermined speed.

The object attribute information is data for defining e.g. the color, the size, and the shape of each object defined by the object data.

The sound data D2 is sound data to be reproduced in association with a movement of each object defined by the object data. The sound data D2 is sound data obtained by pre-editing sound data set by the user in such a manner that the sound data matches the movement of each object using the technique disclosed in patent literature 1.

Specifically, the sound data D2 is edited in accordance with edition parameters which are correlated in advance to e.g. the contents defined by the object attribute information of each object, and to the contents defined by the animation effect information. With this arrangement, the original sound data of the sound data D2 is edited in such a manner that the reproducing time, the volume, and the sound position match the moving time, the moving pattern of the object.

Further, the animation acquiring section 11 outputs the animation data D1 and the sound data D2 to the animation display control section 13 and to the sound output control section 12, in response to an animation start command inputted by the user via the operation section 19, and then, the animation is reproduced.

In the case where the sound control device 1 is applied to an animation generation device, the animation acquiring section 11 generates animation data D1 and sound data D2, based on a user's setting operation via the operation section 19. Further, in the case where the sound control device 1 is applied to a digital home electrical appliance, the animation acquiring section 11 acquires animation data D1 and sound data D2 generated by the user with use of an animation generation device.

Further, the animation acquiring section 11 detects whether the user has inputted a stop command for stopping reproduction of an animation to the operation section 19 during a reproducing operation of the animation. In the case where the animation acquiring section 11 has detected input of a stop command, the animation acquiring section 11 outputs a stop command detection notification D3 to the animation display control section 13 and to the sound output control section 12.

In this example, in response to start of reproducing an animation, the animation acquiring section 11 starts counting a reproducing time of the animation, and in response to detection of a stop command, measures an elapsed time from the point of time at which the reproduction is started to the point of time at which the stop command is detected. Then, the animation acquiring section 11 outputs an elapsed time notification D5 indicating the measured elapsed time to the sound output control section 12.

The sound analyzing section 16 generates sound attribute information D4 by analyzing the feature of a sound represented by the sound data D2 from a start of the sound to an end of the sound, and stores the generated sound attribute information D4 in the sound attribute information storage 18. Specifically, the sound analyzing section 16 extracts a maximum volume of a sound represented by the sound data D2 from a start of the sound to an end of the sound, and generates the extracted maximum volume, as the sound attribute information D4.

In response to input of the stop command detection notification D3, the sound output control section 12 calculates stop time sound information representing the feature of a sound at the point of time at which reproduction of the animation is stopped, and determines a predetermined output method of the sound that matches the animation, based on the calculated stop time sound information, to reproduce the sound by the determined output method.

Specifically, the sound output control section 12 acquires the sound attribute information D4 from the sound attribute information storage 18, calculates a relative volume of sound (an example of the stop time sound information) relative to the maximum volume represented by the acquired sound attribute information D4 at the point of time at which reproduction of the animation is stopped, and fades out the sound in such a manner that the reduction rate of volume is decreased, as the calculated relative volume is increased.

More specifically, the sound output control section 12 determines sound control information corresponding to a relative volume, referring to a sound control information table TB1 stored in the control information storage 17, calculates a reduction rate based on the determined sound control information and an elapsed time represented by the elapsed time notification D5 to fade out the sound with the calculated reduction rate.

FIG. 4 is a diagram showing an example of a data structure of the sound control information table TB1 stored in the control information storage 17. The sound control information table TB1 includes a relative volume filed F1 and a sound control information field F2. In the sound control information table TB1, relative volumes and sound control information are stored in correlation to each other. In the example shown in FIG. 4, the sound control information table TB1 is provided with three records R1 through R3. The record R1 is configured in such a manner that "large volumes (not less than 60% of the maximum volume)" are stored in the relative sound field F1, and sound control information indicating "a sound is faded out at a reduction rate: (−½)*(volume at stop time/elapsed time)" is stored in the sound control information field F2.

With the above arrangement, in the case where the relative volume at the point of time at which reproduction of an animation is stopped is not less than 60% of the maximum volume, the sound output control section 12 calculates a reduction rate using the formula: (−½)*(volume at stop time/elapsed time), and gradually reduces the volume at the calculated reduction rate to fade out the sound.

The record R2 is configured in such a manner that "medium volumes (not less than 40% but less than 60% of the maximum volume)" are stored in the relative sound field F1, and sound control information indicating "a sound is faded out at a reduction rate: (−1)*(volume at stop time/elapsed time)" is stored in the sound control information field F2.

With the above arrangement, in the case where the relative volume at the point of time at which reproduction of an animation is stopped is not less than 40% but less than 60% of the maximum volume, the sound output control section 12 calculates a reduction rate using the formula: (−1)*(volume at stop time/elapsed time), and gradually reduces the volume at the calculated reduction rate to fade out the sound.

The record R3 is configured in such a manner that "small volumes (less than 40% of the maximum volume)" are stored in the relative sound field F1, and sound control information indicating "a sound is faded out at a reduction rate: (−2)*(volume at stop time/elapsed time)" is stored in the sound control information field F2.

With the above arrangement, in the case where the relative volume at the point of time at which reproduction of an animation is stopped is less than 40% of the maximum volume, the sound output control section 12 calculates a reduction rate using the formula: (−2)*(volume at stop time/ elapsed time), and gradually reduces the volume at the calculated reduction rate to fade out the sound.

As a method for stopping a sound at the point of time at which reproduction of an animation is stopped, generally, there is proposed a method of muting a sound. Muting a sound concurrently with stopping reproduction of an animation, however, may give an impression to the user that the sound is suddenly cut off, and the user may feel the sense of incongruity.

An essential purpose of adding a sound to an animation is to create a high-quality animation by adding a sound. Therefore, it is preferable to terminate the sound in a natural manner as if the sound ceases, as reproduction of an animation is stopped. In view of the above, in this embodiment, in the case where reproduction of an animation is suspended, the sound is faded out.

Further, in the case where the volume of sound at the point of time at which reproduction of an animation is stopped is large, turning down the volume quickly within a short time may make the user feel the sense of incongruity. On the other hand, in the case where the volume of sound at the point of time at which reproduction of an animation is stopped is relatively small, the user may not feel the sense of incongruity, even if the volume is quickly turned down within a short time.

In view of the above, the sound control information table TB1 shown in FIG. 4 is set in such a manner that the absolute value of the coefficient of the reduction rate is decreased from 2 to 1, and then to ½, as the relative volume is increased.

With the above arrangement, the sound is moderately faded out, as the volume of sound at the point of time at which reproduction of an animation is stopped is increased. This enables to stop the sound, without giving the sense of incongruity to the user.

In the example shown in FIG. 4, the sound control information table TB1 is described in the form of a table. Alternatively, as far as the format is readable by a computer, such as a text format, an XML format, or a binary format, the table may be described in a variety of formats.

Further, in the example shown in FIG. 4, three sound control information is set in correspondence to relative volumes. Alternatively, four or more, or two sound control information may be set in correspondence to relative volumes. Further alternatively, it is possible to use a function, as the sound control information, for calculating a reduction rate based on a volume and an elapsed time as an argument, and to fade out the sound by using the reduction rate calculated by the function. Further, the threshold values of relative volume are not limited to 40% and 60% as shown in FIG. 4, and values other than the above e.g. 30%, 50%, 70% may be used, as necessary.

In the case where an elapsed time until reproduction of an animation is stopped is long, quickly fading out the sound may give an impression to the user that the sound is suddenly changed, and the user may feel the sense of incongruity.

In view of the above, each of the three sound control information shown in FIG. 4 is provided with a term (volume at stop time/elapsed time). In other words, the absolute value of the reduction rate is set to a smaller value, as the elapsed time until reproduction of an animation is stopped is increased, and the absolute value of the reduction rate is set to a larger value, as the elapsed time is decreased.

With this arrangement, the sound is moderately faded out, as the elapsed time until reproduction of an animation is stopped is increased. This reduces a likelihood that the user may feel the sense of incongruity.

Figure 5:
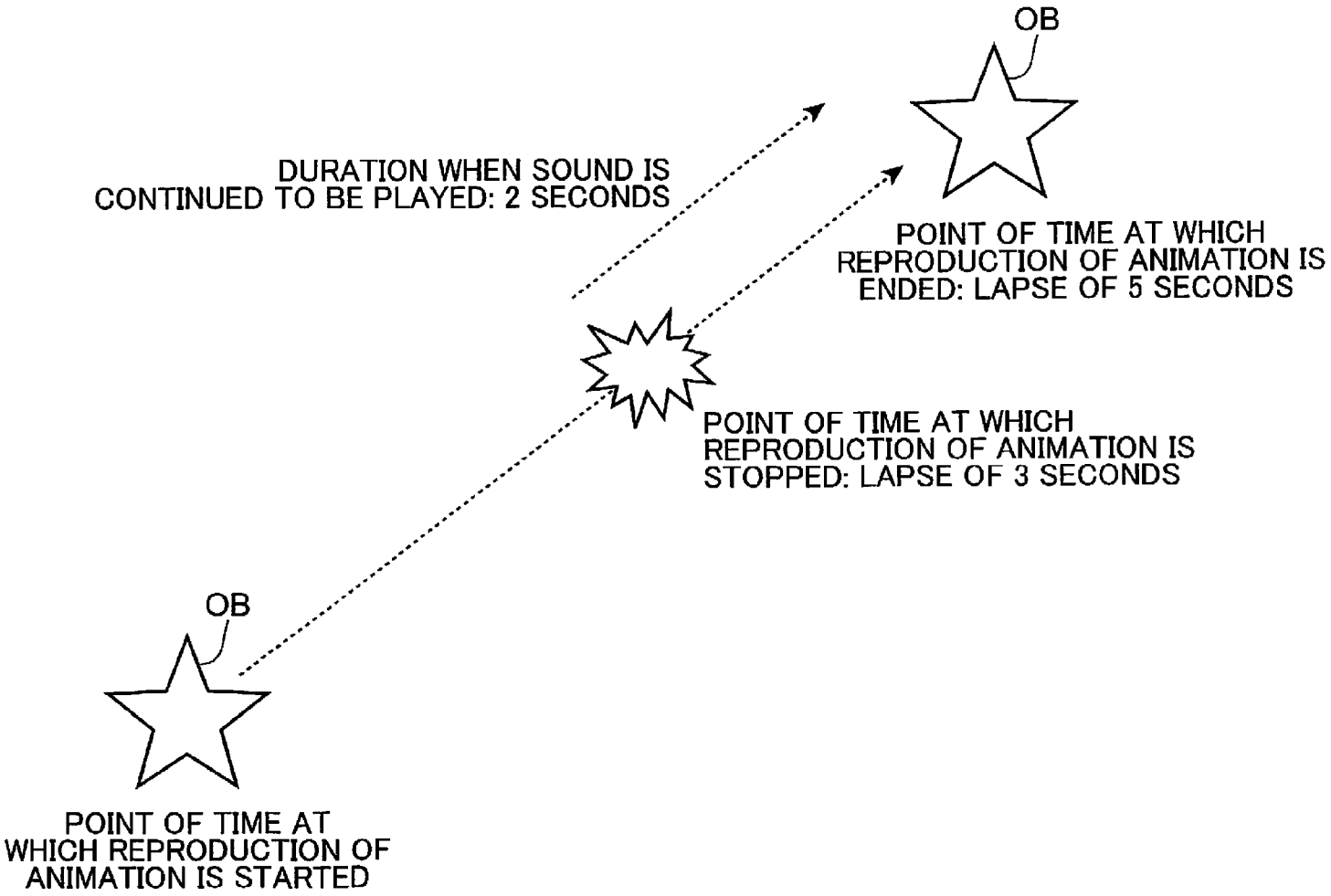
FIG. 5 is a diagram showing a movement of animation in the embodiment of the invention.

FIG. 5 is a diagram showing a movement of animation in the embodiment of the invention. In the example shown in FIG. 5, there is illustrated an animation that an object OB is slidingly moved from a lower left position toward an upper right position on a display screen.

In the above example, the sound data D2 is edited in such a manner that the reproducing time lasts for five seconds to match the movement of the object OB. In the example shown in FIG. 5, a stop command is inputted by the user upon lapse of three seconds from the point of time at which reproduction of the animation is started.

Thus, reproduction of the animation is stopped at the point of time upon lapse of three seconds from the point of time at which reproduction of the animation is started, and movement of the object OB is stopped thereat. In the conventional technique, no processing is applied to sound data in the case where reproduction of an animation is suspended. As a result, the sound is continued to be played for two seconds from the point of time upon lapse of three seconds i.e. from a timing at which a stop command is inputted, to the point of time upon lapse of five seconds i.e. to a timing at which reproduction of the animation is ended. Accordingly, the integrity between the movement and the sound of animation has been lost.

In contrast, in this embodiment, a sound is faded out in accordance with the sound control information at the point of time at which a stop command is inputted. Thus, it is possible to secure the integrity between the movement and the sound of animation.

Figures 6, 7:
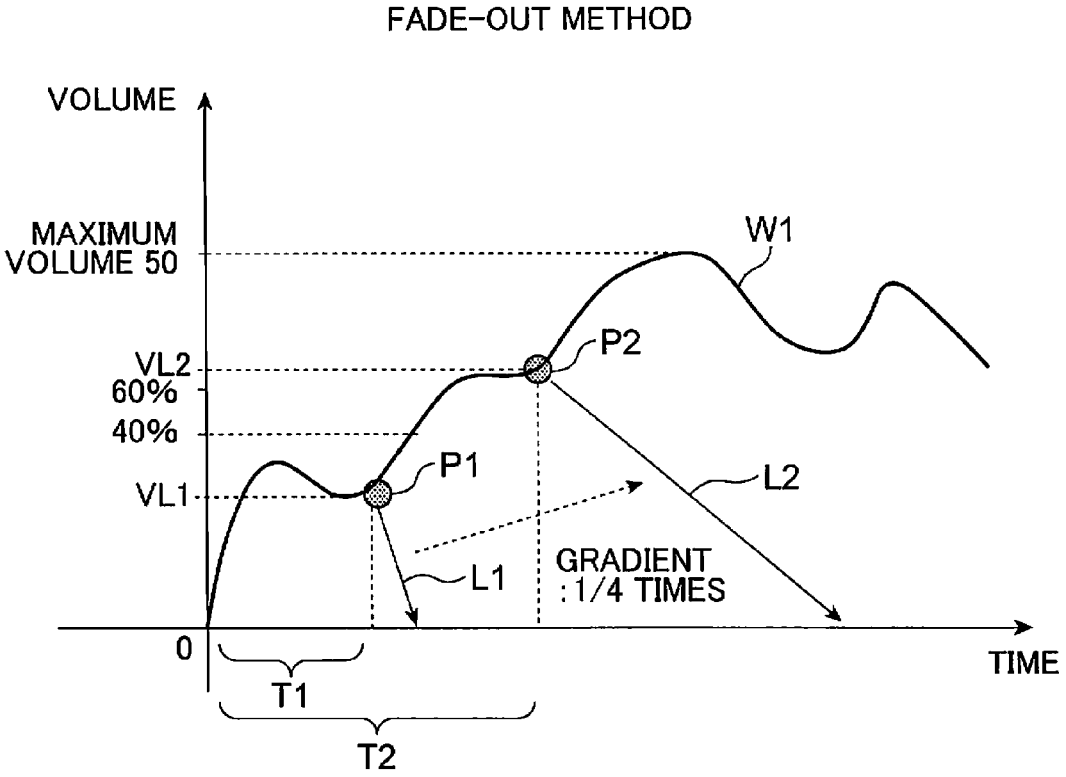
FIG. 6 is a graph for describing a fade-out method to be used in the embodiment.
FIG. 7 is a diagram showing an example of a data structure of a sound attribute information table stored in a sound attribute information storage.

FIG. 6 is a graph for describing a fade-out method to be used in this embodiment. In FIG. 6, the vertical axis denotes a volume, and the horizontal axis denotes a time.

A waveform W1 denotes a sound waveform of the sound data D2. The maximum volume of the waveform W1 is set to level 50. Therefore, the sound attribute information D4 has a value of 50. Let it be assumed that the user has inputted a stop command at a point of time P1, which corresponds to the end of an elapsed time T1 from the point of time at which reproduction of an animation is started. The volume level is a numerical value indicating the magnitude of volume set in a predetermined range (e.g. in the range from 0 to 100).

In the above case, since the relative volume (=VL1/50) relative to the volume VL1 at the point of time P1 is less than 40% of the maximum volume, a reduction rate DR1 is calculated by using the formula:(−2)*(volume at stop time/elapsed time), which is represented by the sound control information stored in the sound control information field F2 of the record R3 shown in FIG. 4, and the sound is faded out at the reduction rate DR1.

Thus, the sound is faded out in such a manner that the volume is gradually decreased from the volume VL1 to the volume 0 along a straight line L1 having a gradient corresponding to the reduction rate DR1.

On the other hand, let it be assumed that the user has inputted a stop command at a point of time P2, which corresponds to the end of an elapsed time T2 from the point of time at which reproduction of an animation is started. In this case, since the relative volume (=VL2/50) relative to the volume VL2 at the point P2 is not less than 60% of the maximum volume, a reduction rate DR2 is calculated by using the formula:(−½)*(volume at stop time/elapsed time), which is represented by the sound control information stored in the sound control information field F2 of the record R1 shown in FIG. 4, and the sound is faded out at the reduction rate DR2.

Thus, the sound is faded out in such a manner that the volume is gradually decreased from the volume VL2 to the volume 0 along a straight line L2 having a gradient corresponding to the reduction rate DR2.

In this example, the reduction rate DR2 has a value of substantially one-fourth the value of the reduction rate DR1. Accordingly, the relative volume is set to a larger value, in the case where a stop command is inputted at the elapsed time T2, as compared with the case where a stop command is inputted at the elapsed time T1. Thus, it is clear that the sound is moderately faded out.

Referring back to FIG. 1, the sound output section 15 includes e.g. a speaker, and a control circuit for controlling the speaker. The sound output section 15 converts the sound data D2 into a sound, and outputs the sound, in response to a sound output command to be outputted from the sound output control section 12.

In the case where an animation based on animation data is reproduced, and in response to input of a stop command by the user, the animation display section 13 stops reproduction of the animation. Specifically, the animation display control section 13 outputs, to the display section 14, a rendering command for displaying the animation represented by the animation data D1 on a display screen, and causes the display section 14 to display the animation.

In this example, in response to input of a stop command detection notification D3 from the animation acquiring section 11, the animation display section 13 judges that the user has inputted a stop command, and then, outputs a rendering stop command for stopping a rendering operation to the display section 14 to stop reproduction of the animation.

The display section 14 includes a graphic processor including a rendering buffer, and a display for displaying image data written in the rendering buffer. The display section 14 successively writes image data as frame images of an animation into the rendering buffer in response to a rendering command to be outputted from the animation display control section 13, and displays the animation by successively displaying the frame images on the display.

The operation section 19 is constituted of e.g. a remote controller of a digital home electrical appliance such as a digital TV or a DVD recorder, or a keyboard; and accepts an operation/input from the user. In this embodiment, in particular, the operation section 19 accepts an animation start command to start reproduction of an animation, and a stop command to suspend reproduction of an animation.

The control information storage 17 is constituted of a e.g. non-volatile rewritable storage, and stores the sound attribute information table TB1 shown in FIG. 4.

The sound attribute information storage 18 is constituted of e.g. a rewritable non-volatile storage, and stores the sound attribute information D4 generated by the sound analyzing section 16. FIG. 7 is a diagram showing an example of a data structure of a sound attribute information table TB2 stored in the sound attribute information storage 18.

The sound attribute information table TB2 is provided with a field F3 for storing the file name of sound data D2, and a field F4 for storing a maximum volume of the sound data D2. In the sound attribute information table TB2, the file name of the sound data D2, and the maximum volume of the sound data D2 are stored in correlation to each other. In this embodiment, since the maximum volume is used as the sound attribute information D4, the maximum volume stored in the maximum volume filed F4 serves as the sound attribute information D4. In the example shown in FIG. 7, as a result of analyzing the sound data D2 whose file name is "myMusic.wav", the maximum volume of the sound data D2 is 50. Thus, the file having the file name "myMusic.wav" is stored in the file name field F3, and the level 50 is stored in the maximum volume field F4.

Referring to FIG. 7, the sound attribute information table TB2 is constituted of one record. Alternatively, records may be added depending on the number of sound data D2 to be acquired by the animation acquiring section 11.

Figure 2:
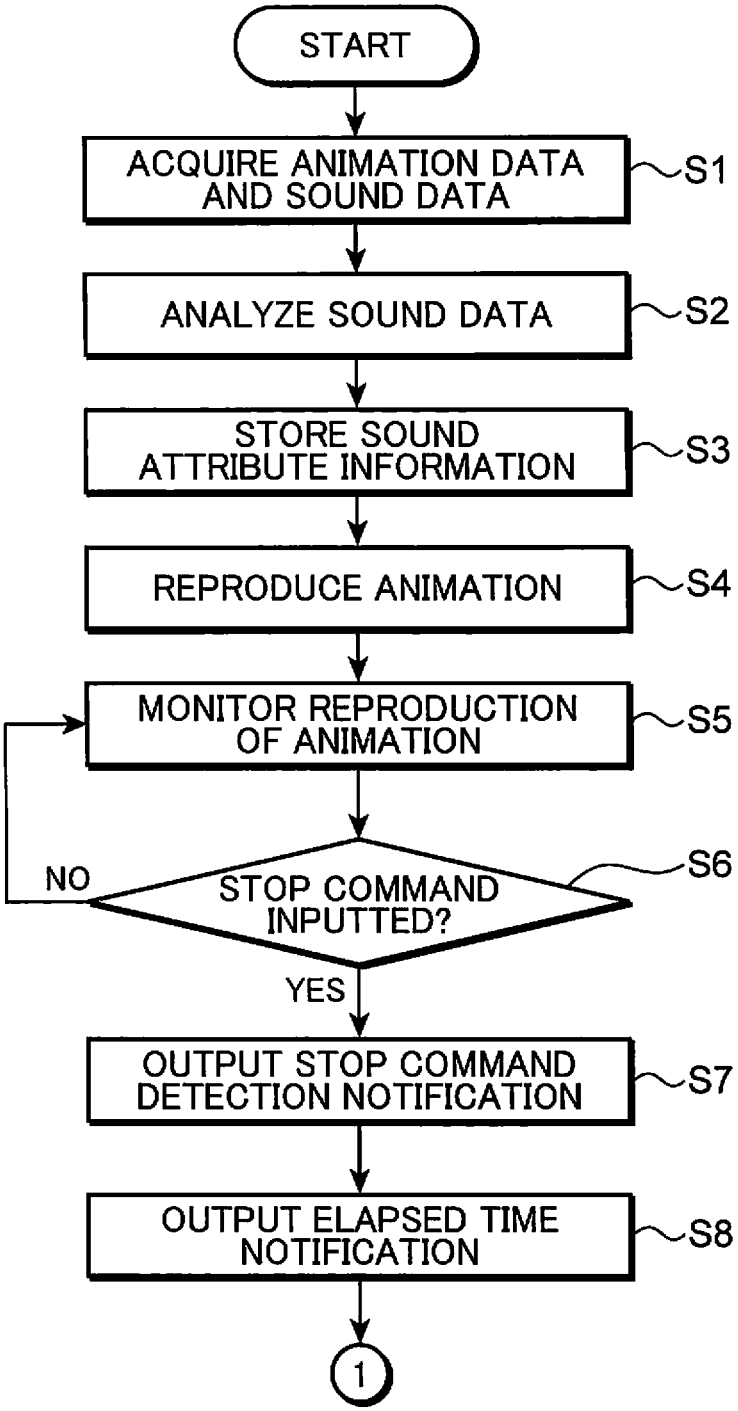
FIG. 2 is a first-half part of a flowchart showing a flow of processing to be performed by the sound control device in the embodiment of the invention.
Figure 3:
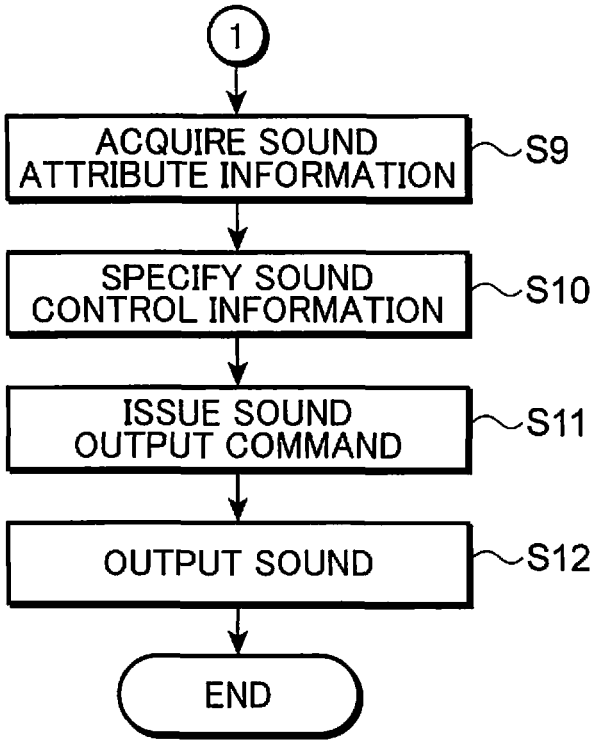
FIG. 3 is a second-half part of the flowchart showing a flow of processing to be performed by the sound control device in the embodiment of the invention.

FIG. 2 and FIG. 3 are a flowchart showing a flow of processing to be performed by the sound control device 1 in the embodiment of the invention. In Step S1, the animation acquiring section 11 acquires animation data D1 and sound data D2. The sound data D2 is sound data obtained by editing sound data designated by the user in accordance with the movement of the animation data D1. In other words, the reproducing time, the volume, the sound position, and the like of the sound data D2 are adjusted in advance depending on the color, the size, and the shape of an object represented by the animation data D1.

Then, the sound analyzing section 16 acquires the sound data D2 edited by the animation acquiring section 11, and analyzes the acquired sound data D2 (Step S2); and specifies a maximum volume, and stores the specified maximum volume in the sound attribute information storage 18, as sound attribute information D4 (Step S3).

Then, the animation display control section 13 acquires the animation data D1 from the animation acquiring section 11, outputs a rendering command for displaying the animation represented by the acquired animation data D1 on the display section 14, and starts reproduction of the animation (Step S4). In this example, the animation acquiring section 11 also starts measuring a reproducing time of the animation.

Upon starting reproduction of the animation, the animation acquiring section 11 monitors whether an animation stop command has been inputted by the user during a period until reproduction of the animation is ended (Step S5).

Then, upon detecting input of a stop command (YES in Step S6), the animation acquiring section 11 outputs a stop command detection notification D3 to the animation display control section 13 and to the sound output control section 12 (Step S7). On the other hand, in the absence of detection of input of a stop command (NO in Step S6), the animation acquiring section 11 returns the processing to Step S5.

Then, the animation acquiring section 11 outputs an elapsed time notification D5 indicating an elapsed time from the point of time at which reproduction of an animation is started to the point of time at which a stop command is detected, to the sound output control section 12 (Step S8).

Upon receiving the elapsed time notification D5, the sound output control section 12 acquires the sound attribute information D4 of the animation being reproduced, from the sound attribute information storage 18 (Step S9).

Then, the sound output control section 12 calculates a relative volume relative to the maximum volume represented by the sound attribute information D4 at the point of time at which reproduction of the animation is stopped, and specifies sound control information corresponding to the calculated relative volume from the sound control information table TB1 (Step S10).

Then, the sound output control section 12 calculates a reduction rate by substituting a volume at the point of time at which reproduction of the animation is stopped, and an elapsed time represented by the elapsed time notification D5 in the formula representing the specified sound control information, and outputs a sound output command to the sound output section 15 so as to fade out the sound at the calculated reduction rate (Step S11).

Then, the sound output section 15 outputs a sound in response to the sound output command outputted from the sound output control section 12 (Step S12). With this operation, as shown in FIG. 6, the sound is faded out at a reduction rate suitable for the volume of sound at the point of time at which reproduction of the animation is stopped.

In the thus-constructed sound control device 1, in the case where reproduction of an animation accompanied with a sound is stopped by the user during a reproducing operation, the sound is faded out at a reduction rate suitable for the volume of sound at the point of time at which reproduction of the animation is stopped, and suitable for an elapsed time from the point of time at which the reproduction is started to the point of time at which the reproduction is stopped. With this arrangement, it is possible to automatically adjust the sound, as if the sound ceases in a natural manner, as reproduction of an animation is stopped. Thus, it is possible to stop the sound without giving the user the sense of incongruity, even if reproduction of an animation is stopped during a reproducing operation.

In this embodiment, the sound data D2 is analyzed by the sound analyzing section 16 to generate the sound attribute information D4, and the generated sound attribute information D4 is stored in the sound attribute information storage 18. Alternatively, the animation acquiring section 11 may analyze the sound data D2 in advance to generate the sound attribute information D4, and the generated sound attribute information D4 may be stored in the sound attribute information storage 18.

Further, in this embodiment, a reduction rate is calculated, using the sound control information stored in the sound control information table TB1, and the sound is faded out at the calculated reduction rate. The invention is not limited to the above. Specifically, a predetermined sound stopping pattern may be stored in the control information storage 17 in accordance with stop time sound information to be calculated in response to stop of the animation during a reproducing operation, and the sound may be stopped with the sound stopping pattern stored in the control information storage 17 in response to input of a stop command by the user.

In this example, for instance, as a sound stopping pattern, there may be used sound data represented by a sound waveform from the point of time at which reproduction of an animation is stopped to the point of time at which the sound is stopped. In this modification, plural sound stopping patterns corresponding to stop time sound information may be stored in advance in the control information storage 17. Then, the sound output control section 12 may specify a sound stopping pattern corresponding to a relative volume i.e. the stop time sound information, and may output a sound output command for outputting a sound with the specified sound stopping pattern, to the sound output section 15. This modification may be applied to the second embodiment to be described in the following.

Second Embodiment

A sound control device 1 in the second embodiment has a feature that a sound is stopped depending on a frequency characteristic, in place of depending on a volume, in response to input of a stop command by the user. The entire configuration of the second embodiment is substantially the same as the configuration shown in FIG. 1. Further, a flow of processing in this embodiment is substantially the same as the flow shown in FIG. 2 and FIG. 3. Furthermore, description on the elements in this embodiment substantially identical or equivalent to those in the first embodiment is omitted herein.

In this embodiment, a sound analyzing section 16 calculates a time-wise transition of frequency characteristic from a start of sound data D2 to an end of sound data D2, generates the calculated time-wise transition of frequency characteristic, as sound attribute information D4, and stores the generated sound attribute information D4 in a sound attribute information storage 18.

As a method for analyzing a frequency characteristic of sound, there is known a technique of applying a discrete Fourier transform to sound data as an input signal. The discrete Fourier transform is expressed by e.g. the following formula (1).

$$F(u) = \sum_{x=0}^{M-1} f(x)e^{-2\pi i\left(\frac{ux}{M}\right)} \tag{1}$$

where u=0, . . . , M−1

In the above formula, f(x) denotes a one-dimensional input signal, x denotes a variable that defines f, F(u) denotes a one-dimensional frequency characteristic of f(x), u denotes a frequency corresponding to x, and M denotes the number of sampling points.

The sound analyzing section 16 calculates a frequency characteristic based on sound data D2 as an input signal, using the formula (1).

The discrete Fourier transform is generally executed by using a high-speed Fourier transform. A variety of methods such as Cooley-Tukey algorithm and Prime Factor algorithm are proposed as the high-speed Fourier transform method. In this embodiment, only an amplitude characteristic (amplitude spectrum) is used as the frequency characteristic, and a phase characteristic is not used. Accordingly, a computation time does not matter greatly, and any method may be used as the discrete Fourier transform.

Figure 8A:
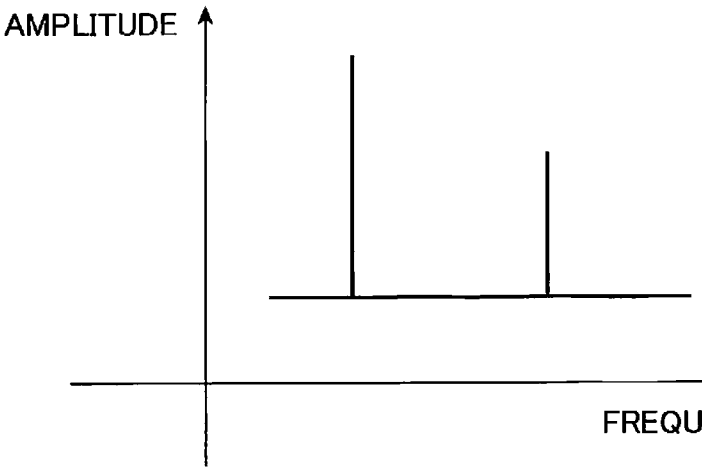
FIG. 8 are graphs showing a frequency characteristic analyzed by a sound analyzing section.
Figure 8B:
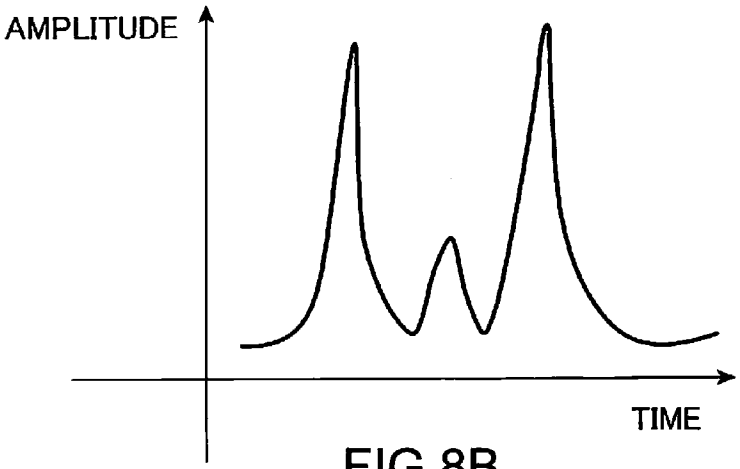
Figure 8C:
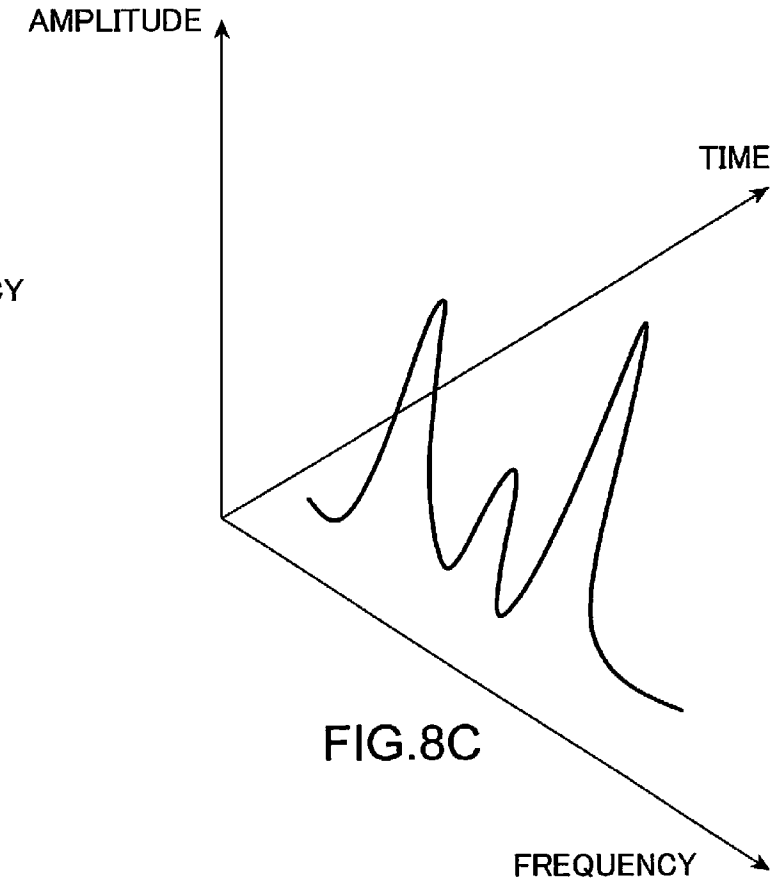

FIG. 8 are graphs showing a frequency characteristic analyzed by the sound analyzing section 16, wherein (A) shows a frequency characteristic of sound data D2 at a certain point of time, (B) shows the sound data D2, and (C) shows the frequency characteristic at a certain point of time. The sound analyzing section 16 calculates the frequency characteristic shown in (C) of FIG. 8 at plural points of time, generates the frequency characteristics at the plural points of time as sound attribute information D4, and stores the generated sound attribute information D4 in the sound attribute information storage 18.

For instance, the sound analyzing section 16 may set a calculation window that defines a calculation period of frequency characteristic of sound data D2 along a time axis, and may calculate a time-wise transition of a frequency characteristic by repeating calculations of a frequency characteristic of the sound data D2, while shifting the calculation window along the time axis.

In response to input of a stop command detection notification D3, a sound output control section 12 specifies a stop time frequency characteristic (an example of stop time sound information), which is a frequency characteristic at the end of an elapsed time represented by an elapsed time notification D5, from the sound attribute information storage 18. Then, in the case where the stop time frequency characteristic lies in a predetermined non-audible frequency range, the sound output control section 12 mutes the sound. Further, the sound output control section 12 sets the reduction rate of volume at a fade-out time to a smaller value, in the case where the stop time frequency characteristic lies in a predetermined high sensitivity range where the human hearing sensitivity is high, as compared with the case where the stop time frequency characteristic lies in a region of the audible frequency range, other than the high sensitivity range.

It is known that the human hearing sensitivity has a frequency characteristic such that the lowest frequency of the hearing sensitivity is about 20 Hz, and that the hearing sensitivity is high at or around 2 kHz. In view of this, in this embodiment, a frequency range of not higher than 20 Hz is used as a non-audible frequency range, and a frequency range of higher than 20 Hz but not higher than the upper limit frequency (e.g. 3.5 kHz to 7 kHz) of the human hearing sensitivity, is used as an audible frequency range.

Figure 9:
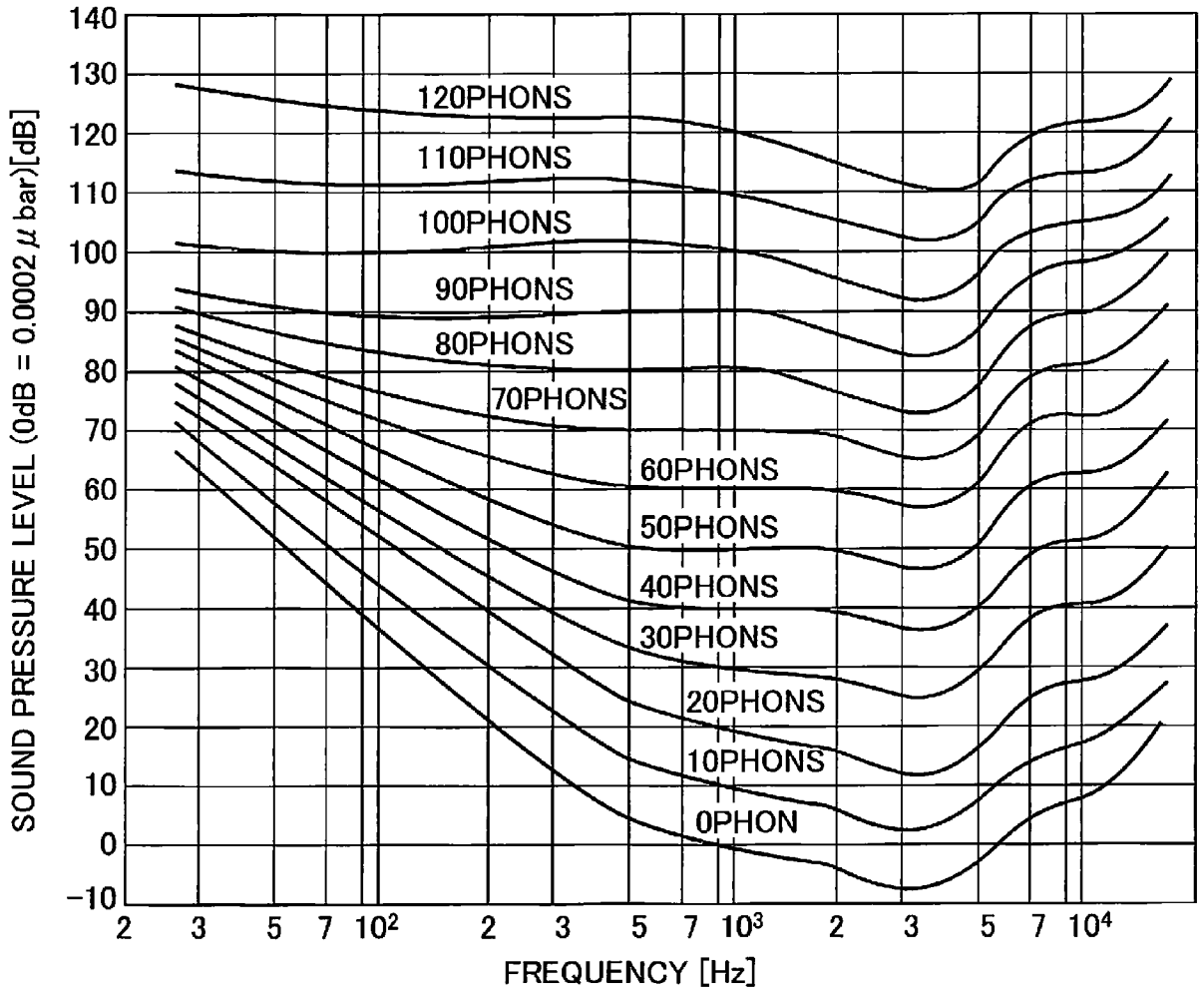
FIG. 9 is a graph showing isosensitivity curves by Fletcher-Munson.
Figure 11:
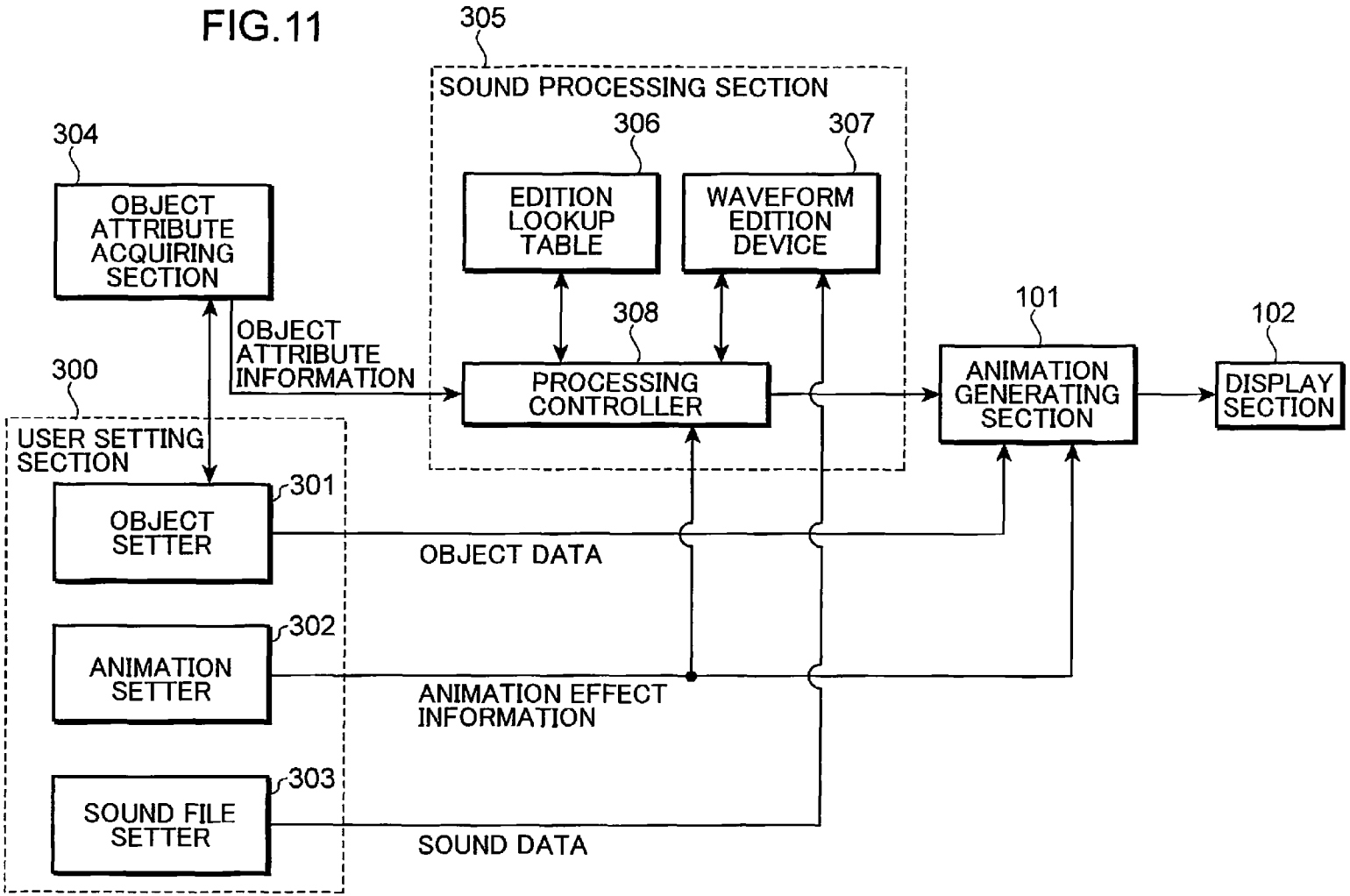
FIG. 11 is a block diagram showing an animation generation device disclosed in patent literature 1.

FIG. 9 is a graph showing isosensitivity curves by Fletcher-Munson. In FIG. 9, the vertical axis denotes a sound pressure level (dB), and the horizontal axis denotes a frequency (Hz) by log scale.

According to the isosensitivity curves by Fletcher-Munson shown in FIG. 9, it is known that a sound is less likely to be audible, as the frequency is lowered, or as the volume is decreased, in a low-frequency range of about 500 Hz or lower.

In view of the above, in this embodiment, the sound output control section 12 determines a sound output method, using a sound control information table TB11 shown in FIG. 10. FIG. 10 is a diagram showing an example of a data structure of the sound control information table TB11 in the second embodiment of the invention. As shown in FIG. 10, the sound control information table TB11 includes a frequency field F11 and a sound control information field F12. In the sound control information table TB11, frequencies and sound control information are stored in correlation to each other. In the example shown in FIG. 10, the sound control information table TB11 is provided with five records R11 through R15.

The record R11 is configured in such a manner that a "non-audible frequency range" is stored in the frequency field F11, and sound control information indicating "mute" is stored in the sound control information field F12.

With the above arrangement, in the case where the stop time frequency characteristic lies in the non-audible frequency range, the sound output control section 12 mutes the sound.

The records R12 through R15 correspond to the audible frequency range. The record R12 is configured in such a manner that frequencies "20 Hz to 500 Hz" are stored in the frequency field F11, and sound control information indicating "a sound is faded out at a reduction rate: (−2)*(volume at stop time/elapsed time)" is stored in the sound control information field F12.

With the above arrangement, in the case where the stop time frequency characteristic lies in a frequency range from 20 Hz to 500 Hz, the sound output control section 12 calculates a reduction rate using the formula: (−2)*(volume at stop time/elapsed time), and gradually reduces the volume at the calculated reduction rate to fade out the sound.

The record R13 is configured in such a manner that frequencies "500 Hz to 1,500 Hz" are stored in the frequency field F11, and sound control information indicating "a sound is faded out at a reduction rate: (−1)*(volume at stop time/elapsed time)" is stored in the sound control information field F12.

With the above arrangement, in the case where the stop time frequency characteristic lies in a frequency range of not lower than 500 Hz but lower than 1,500 Hz, the sound output control section 12 calculates a reduction rate using the formula: (−1)*(volume at stop time/elapsed time), and gradually reduces the volume at the calculated reduction rate to fade out the sound.

The record R14 is configured in such a manner that frequencies "1,500 Hz to 2,500 Hz" are stored in the frequency field F11, and sound control information indicating "a sound is faded out at a reduction rate: (−½)*(volume at stop time/elapsed time)" is stored in the sound control information field F12. In this embodiment, the frequency range of from "1,500 Hz to 2,500 Hz" corresponds to the high sensitivity range. The above numerical values are merely an example, and the high sensitivity range may be narrower or broader than the aforementioned range.

With the above arrangement, in the case where the stop time frequency characteristic lies in a frequency range of not lower than 1,500 Hz but lower than 2,500 Hz, the sound output control section 12 calculates a reduction rate using the formula: (−½)*(volume at stop time/elapsed time), and gradually reduces the volume at the calculated reduction rate to fade out the sound.

The record R15 is configured in such a manner that frequencies "2,500 Hz or higher" are stored in the frequency field F11, and sound control information indicating "a sound is faded out at a reduction rate: (−1)*(volume at stop time/elapsed time)" is stored in the sound control information field F12.

With the above arrangement, in the case where the stop time frequency characteristic lies in a frequency range of 2,500 Hz or higher, the sound output control section 12 calculates a reduction rate using the formula: (−1)*(volume at stop time/elapsed time), and gradually reduces the volume at the calculated reduction rate to fade out the sound.

In other words, in the sound control information table TB11, as shown by the records R12 through R15, the coefficient to be used in the high sensitivity range is −½. This makes it possible to calculate the absolute value of the reduction rate in the high sensitivity range to be a small value, as compared with the case where the absolute value of the reduction rate is calculated in a region of the audible frequency range, other than the high sensitivity range.

Accordingly, in the case where the stop time frequency characteristic lies in the vicinity of 2 kHz, where the human hearing sensitivity is high, the sound is slowly faded out, as compared with the case where the stop time frequency characteristic lies in the other region of the audible frequency range. This enables to stop the sound without giving the sense of incongruity to the user.

Alternatively, the sound output control section 12 may obtain a peak frequency i.e. a frequency indicating that the stop time frequency characteristic reaches a peak, and may determine in which region the stop time frequency characteristic lies, based on a determination as to which region of the frequency range shown in FIG. 10 the peak frequency belongs to.

In the first and second embodiments, in the case where reproduction of an animation is stopped in response to input of a stop command by the user, and the reproduction is resumed by the user, the reproduction of animation is resumed at a position corresponding to the point of time at which the reproduction of animation has stopped. In this case, the volume and the frequency characteristic at the point of time at which the reproduction of animation has stopped may be recorded.

In the case where reproduction of an animation different from the animation whose reproduction has stopped is designated by the user, the designated animation may be reproduced, referring to the recorded volume or the recorded frequency characteristic.

For instance, in the case where the stop time frequency characteristic lies in a frequency range of 20 Hz or lower, or in a frequency range of not lower than 20 Hz but lower than 500 Hz, the same frequency range may be used for reproduction of a next animation.

Further, in the case where the stop time frequency characteristic lies in the vicinity of 2 kHz, in other words, lies in the high sensitivity range, it is possible to fade out the sound of a previous animation at the reduction rate: (−1)*(volume at stop time/elapsed time) shown in FIG. 10, and then to fade out the sound of a next animation at an increase rate: (volume at stop time/elapsed time). The same period as the fade-out period may be used as the fade-in period.

The following is a summary of the technical features of the sound control device.

(1) A sound control device according to an aspect of the invention includes an animation acquiring section which acquires animation data representing an animation produced in advance based on a setting operation by a user, and sound data representing a sound to be reproduced in association with the animation data; a sound analyzing section which analyzes a feature of the sound data from start to finish to generate a sound attribute information; an animation display control section which reproduces the animation based on the animation data, and stops the reproduction of the animation when a stop command for stopping animation reproduction is inputted; and a sound output control section which reproduces the sound based on the sound data. In this arrangement, the sound output control section calculates, when the stop command is inputted, a stop time sound information representing a feature of sound at a point of time at which the reproduction of the animation is stopped using the sound attribute information, and determines, based on the calculated stop time sound information, a predetermined output method for the sound that matches the animation whose reproduction is stopped, and allows the reproduction of the sound by the determined output method.

With the above arrangement, in the case where reproduction of an animation accompanied with a sound is stopped by the user during a reproducing operation, stop time sound information indicating a feature of the sound at the point of time at which reproduction of the animation is stopped is calculated, and a predetermined output method of the sound that matches the animation whose reproduction is stopped is determined, based on the stop time sound information. Accordingly, it is possible to automatically adjust the sound, as if the sound ceases in a natural manner, as reproduction of an animation is stopped. Thus, it is possible to output the sound without giving the sense of incongruity to the user, even if reproduction of an animation is stopped during a reproducing operation.

(2) Preferably, the sound control device may further include a control information storage which stores a plurality of predetermined sound control informations corresponding to stop time sound informations, wherein the sound output control section determines a sound control information corresponding to the stop time sound information to stop the sound in accordance with the determined sound control information.

With the above arrangement, the sound control information corresponding to the stop time sound information is determined from among the sound control information stored in the sound control information storage, and the sound is stopped depending on the determined sound control information. Thus, it is possible to determine the sound output method easily and speedily.

(3) Preferably, the sound control device may further include a sound attribute information storage which stores the sound attribute information, wherein the sound output control section calculates the stop time sound information using the sound attribute information stored in the sound attribute information storage.

With the above arrangement, the sound attribute information is stored in advance in the sound attribute information storage prior to reproduction of an animation. Accordingly, the sound output control section can speedily determine the sound attribute information at the point of time at which reproduction of the animation is stopped, and speedily determine the sound output method.

(4) Preferably, the sound attribute information may indicate a maximum volume of the sound data, the stop time sound information indicates a relative volume of the sound at the point of time at which the reproduction of the animation is stopped and in relative to the maximum volume, and the sound output control section fades out the sound in such a manner that the reduction rate of volume decreases as the relative volume increases.

With the above arrangement, the sound is faded out in such a manner that the reduction rate is set to a smaller value, as the volume of sound at the point of time at which reproduction of the animation is increased. Accordingly, in the case where the volume of sound at the point of time at which reproduction of the animation is stopped is large, the sound is slowly faded out. This prevents the user from feeling the sense of incongruity. On the other hand, in the case where the volume of sound at the point of time at which reproduction of the animation is stopped is small, the sound is faded out quickly. This allows for stopping the sound quickly, without giving the sense of incongruity to the user.

(5) Preferably, the sound output control section may set the reduction rate to a smaller value as an elapsed time until reproduction of the animation is stopped increases.

With the above arrangement, the sound is moderately faded out, as the elapsed time until reproduction of an animation is stopped is increased. This enables to stop the sound, without giving the sense of incongruity to the user.

(6) Preferably, the sound attribute information may indicate a time-wise transition of a frequency characteristic of the sound data from start to finish, the stop time sound information may be a stop time frequency characteristic indicating a frequency characteristic of the sound data at the point of time at which the reproduction of the animation is stopped, and the sound output control section may mute the sound in the case where the stop time frequency characteristic lies in a predetermined non-audible frequency range, and may fade out the sound in the case where the stop time frequency characteristic lies in an audible frequency range higher than the non-audible frequency range.

With the above arrangement, in the case where the stop time frequency characteristic lies in the non-audible frequency range, the sound is muted; and in the case where the stop time frequency characteristic lies in the audible frequency range, the sound is faded out. This enables to stop the sound without giving the sense of incongruity to the user.

(7) Preferably, the sound output control section may set the reduction rate of volume at a fade-out time to a smaller value in the case where the stop time frequency characteristic lies in a predetermined high sensitivity range where the human hearing sensitivity is high, as compared with the case where the stop time frequency characteristic lies in the other region of the audible frequency range.

With the above arrangement, the sound is slowly faded out, in the case where the stop time frequency characteristic lies in the high sensitivity range, as compared with the case where the stop time frequency characteristic lies in the other region of the audible frequency range. This enables to stop the sound without giving the sense of incongruity to the user.

(8) Preferably, the sound output control section may set the reduction rate to a smaller value as an elapsed time until reproduction of the animation is stopped increases.

With the above arrangement, the sound is slowly faded out, as the elapsed time until reproduction of an animation is stopped is increased. This enables to stop the sound without giving the sense of incongruity to the user.

(9) Preferably, the sound output control section may stop the sound with a predetermined sound stopping pattern corresponding to the stop time sound information.

With the above arrangement, in the case where reproduction of an animation is stopped, the sound can be easily and speedily stopped.

INDUSTRIAL APPLICABILITY

In the device of the present invention, in the case where an animation accompanied with a sound is stopped by the user during execution of animation display, a sound output method is determined to match the animation to be stopped. Accordingly, the invention is advantageous in enhancing usability for the users who develop the animation technology with an animation creation tool, and for the users who utilize a user interface of a digital home electrical appliance. In particular, the invention is useful for animation software development which is expected to progress more and more in the future.

The invention claimed is:

1. A sound control device, comprising:

an animation acquiring section which acquires animation data representing an animation produced in advance based on a setting operation by a user, and sound data representing a sound to be reproduced in association with the animation data;

a sound analyzing section which analyzes a feature of the sound data from start to finish to generate a sound attribute information;

an animation display control section which reproduces the animation based on the animation data, and stops the reproduction of the animation when a stop command for stopping animation reproduction is inputted; and a sound output control section which reproduces the sound based on the sound data, wherein the sound output control section calculates, when the stop command is inputted, a stop time sound information representing a feature of sound at a point of time at which the reproduction of the animation is stopped using the sound attribute information, and determines, based on the calculated stop time sound information, a predetermined output method for the sound that matches the animation whose reproduction is stopped, and allows the reproduction of the sound by the determined output method.

2. The sound control device according to claim 1, further comprising:

a control information storage which stores a plurality of predetermined sound control informations corresponding to stop time sound informations, wherein the sound output control section determines a sound control information corresponding to the stop time sound information to stop the sound in accordance with the determined sound control information.

3. The sound control device according to claim 1, further comprising:

a sound attribute information storage which stores the sound attribute information, wherein the sound output control section calculates the stop time sound information using the sound attribute information stored in the sound attribute information storage.

4. The sound control device according to claim 1, wherein the sound attribute information indicates a maximum volume of the sound data, the stop time sound information indicates a relative volume of the sound at the point of time at which the reproduction of the animation is stopped and in relative to the maximum volume, and the sound output control section fades out the sound in such a manner that the reduction rate of volume decreases as the relative volume increases.

5. The sound control device according to claim 4, wherein the sound output control section sets the reduction rate to a smaller value as an elapsed time until reproduction of the animation is stopped increases.

6. The sound control device according to claim 1, wherein the sound attribute information indicates a time-wise transition of a frequency characteristic of the sound data from start to finish, the stop time sound information is a stop time frequency characteristic indicating a frequency characteristic of the sound data at the point of time at which the reproduction of the animation is stopped, and the sound output control section mutes the sound in the case where the stop time frequency characteristic lies in a predetermined non-audible frequency range, and fades out the sound in the case where the stop time frequency characteristic lies in an audible frequency range higher than the non-audible frequency range.

7. The sound control device according to claim 6, wherein the sound output control section sets the reduction rate of volume at a fade-out time to a smaller value in the case where the stop time frequency characteristic lies in a predetermined high sensitivity range where the human hearing sensitivity is high, as compared with the case where the stop time frequency characteristic lies in the other region of the audible frequency range.

8. The sound control device according to claim 7, wherein the sound output control section sets the reduction rate to a smaller value as an elapsed time until reproduction of the animation is stopped increases.

9. The sound control device according to claim 1, wherein the sound output control section stops the sound with a predetermined sound stopping pattern corresponding to the stop time sound information.

10. A non-transitory computer-readable recording medium which stores a sound control program for causing a computer to function as: an animation acquiring section which acquires animation data representing an animation produced in advance based on a setting operation by a user, and sound data representing a sound to be reproduced in association with the animation; a sound analyzing section which analyzes a feature of the sound data from start to finish to generate a sound attribute information; an animation display control section which reproduces the animation based on the animation data, and stops the reproduction of the animation when a stop command for stopping animation reproduction is inputted; and a sound output control section which reproduces the sound based on the sound data, wherein the sound output control section calculates, when the stop command is inputted, a stop time sound information representing a sound feature at a point of time at which the reproduction of the animation is stopped using the sound attribute information, and determines, based on the calculated stop time sound information, a predetermined output method for the sound that matches the animation whose reproduction is stopped and allows the reproduction of the sound by the determined output method.

11. A sound control method, comprising:

an animation acquiring step of acquiring, by a computer, animation data representing an animation produced in advance based on a setting operation by a user, and sound data representing a sound to be reproduced in association with the animation data;

a sound analyzing step of analyzing, by the computer, a feature of the sound data from start to finish to generate a sound attribute information;

an animation display control step of reproducing, by the computer, the animation based on the animation data, and stopping the reproduction of the animation when a stop command for stopping animation reproduction is inputted; and a sound output control step of reproducing, by the computer, the sound based on the sound data, wherein in the sound output control step, when the stop command is inputted, a stop time sound information representing a sound feature at a point of time at which the reproduction of the animation is stopped is calculated using the sound attribute information, and a predetermined output method for the sound that matches the animation whose reproduction is stopped is determined based on the calculated stop time sound information, the reproduction of the sound by the determined output method is allowed.

* * * * *